US005960981A

United States Patent [19]

Dodson et al.

[11] Patent Number: 5,960,981

[45] Date of Patent: Oct. 5, 1999

[54] WATER TANK BAFFLE

[75] Inventors: Gary M. Dodson, Dunnellon; William F. Hill, Ocala, both of Fla.

[73] Assignee: Emergency One, Inc., Ocala, Fla.

[21] Appl. No.: 09/094,860

[22] Filed: Jun. 15, 1998

[51] Int. Cl.[6] ..... B65D 81/00

[52] U.S. Cl. ..... 220/563; 220/564; 220/507

[58] Field of Search ..... 220/563, 564, 220/507, 510, 512

[56] References Cited

U.S. PATENT DOCUMENTS 2,134,678 10/1938 Billig et al. .
2,806,622 9/1957 Leirer .
3,913,289 10/1975 Recker .
4,295,307 10/1981 Jensen .
4,334,868 6/1982 Levinrad .

*Primary Examiner*—Joseph M. Moy
*Attorney, Agent, or Firm*—Young & Basile, P.C.

[57] ABSTRACT

A baffle located within a receptacle for liquid to control surging particularly suitable for use with firefighting vehicles having a water supply wherein the baffle is formed of polymeric intersecting longitudinal and transverse plate members having intermeshing slots and reinforcing inserts located in each plate member receive the end region of the intersecting plate member to support the end regions against deformation and displacement.

10 Claims, 2 Drawing Sheets

WATER TANK BAFFLE

BACKGROUND OF THE INVENTION

1. Field of the Invention

The invention pertains to baffles located within liquid receptacles to control surging, and particularly pertains to baffles formed of polymeric material capable of being easily assembled and reinforced.

2. Description of the Related Art

Many types of firefighting vehicles utilize a water storage tank or receptacle for dispensing water upon the fire. Such tanks upon large firefighting vehicles may have capacities of several hundred gallons and for safety and other reasons, it is common to baffle the interior of water receptacles on firefighting vehicles to control surging due to forces imposed upon the water during vehicle movement.

Commonly, the baffles within firefighting vehicle tanks consist of longitudinal and transverse plate members located within the water tank or receptacle to divide the capacity into smaller "cells". Adjacent cells are in communication with each other by openings or passages of such dimension as to prevent objectionable transfer of water between adjacent cells during surging, but are large enough to permit the water from all of the cells to be utilized during water pumping.

The fabricating of water baffles is complicated and time consuming in that extensive welding of intersecting plate members is required, and in the event that the water receptacle and baffles are damaged during a vehicle collision, the repair of the water tank and baffles is expensive and time consuming. It is known to form water tank baffles for firefighting vehicles of polymeric material such as polypropylene or polyethylene, but such baffles also require welding with a polymeric material, and the repair of such polymeric baffles is very difficult as the welds must be cut out and repaired.

OBJECTS OF THE INVENTION

It is an object of the invention to provide a polymeric baffle system for water tanks which is easily assembled, requires a minimum of welding, is effective to control surging, and is easily repairable.

Another object of the invention is to provide a baffle for liquid receptacles entirely formed of polymeric material which minimizes the welding of the baffle components by polymeric welding or solvents.

An additional object of the invention is to provide a baffle for liquid receptacles entirely formed of polymeric material wherein a plurality of intersecting longitudinal and transversely disposed plate members utilize slots and reinforcing inserts to produce high strength mechanical interconnections between assembled plate members simplifying initial assembly, and simplifying disassembly in the event of required repair.

SUMMARY OF THE INVENTION

While it is possible to form the baffle of the invention by using metal components, preferably, the baffle components are formed of a non-corrosive, high strength, polymeric material such as polypropylene or polyethylene, and the tank or receptacle, itself, may be formed of such polymeric material.

The purpose of the water baffle of the invention is to prevent water surging within the water tanks commonly carried by firefighting vehicles. Fire trucks are subjected to rapid starts and stops, sharp turns, and are often driven over uneven terrain. Such movements will cause the water within the water tanks to surge temporarily changing the center of vehicle gravity producing an uncomfortable ride, and at times, even threatening the capsizing of the vehicle. Water baffles within the water tanks divide the water tanks into small "cells" in communication with each other and prevent surging while permitting the water to be effectively withdrawn from the water tank.

The baffle in accord with the invention is formed of a plurality of parallel longitudinal plate members located in the water tank which are transversely intersected by a plurality of transverse plate members. The longitudinal and transverse plate members each include slots intersecting a longitudinal edge of the plate member whereby the slots of the plate members may be aligned and intermeshed. The two types of plate members are of a substantially similar height and the slots thereof extend approximately half way across the transverse dimension of the plate members. Upon assembly of the respective plate members, the longitudinal edges thereof will be disposed adjacent each other, and the fact that approximately one-half of each plate member is received within the slot of the other plate member produces a mechanical connection between plate members resisting relative movement therebetween.

Each plate member is provided with reinforcement insert receiving openings located adjacent an edge of the plate member remote from the slot formed in the associated plate member, and in alignment with such slot. This opening receives a reinforcing insert, preferably formed of polymeric material, having a base located within the opening, and four cantilevered fingers which are slotted defining a pair of slots perpendicular to each other such that one slot defined by the fingers straddles the associated plate member, and the other slot is in alignment with the associated plate member slot.

Each plate member supports a reinforcing insert so that upon the longitudinal and transverse plate members being transversely disposed to each other and their slots aligned, the plate members may be pushed together to mesh the slots, and continued relative movement of the plate members in the direction of their slots causes the leading edges of the plate members to be received within the slot defined between the insert fingers in alignment with the associated plate member slot. In this manner, the longitudinal and transverse plate members are mechanically interlocked together adjacent their longitudinal edges by the insert fingers providing mechanical support of the plate member edges preventing distortion and deforming during water surging.

The slots in the plate members mechanically support the central regions of the plate members while the reinforcing inserts support the edge regions of the plate members, and in the practice of the invention, little, if any, welding or adhesion of the plate members to each other is required. To disassemble the plate members, it is only necessary to withdraw the plate members from each other which releases the plate members from the reinforcing insert of the other plate member and the repair of a baffle system in accord with the invention may be easily accomplished.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
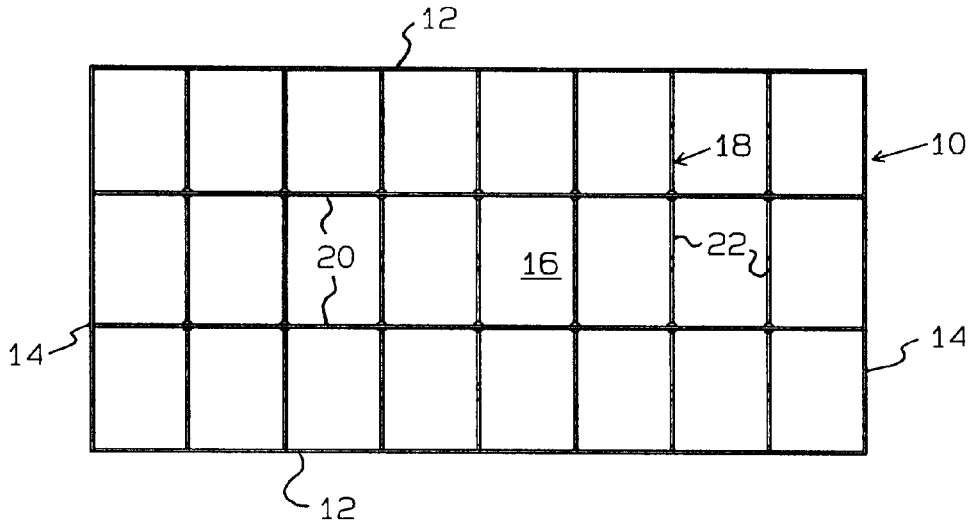
FIG. 1 is a plan view of a liquid tank or receptacle utilizing the concepts of the invention.
Figure 2:
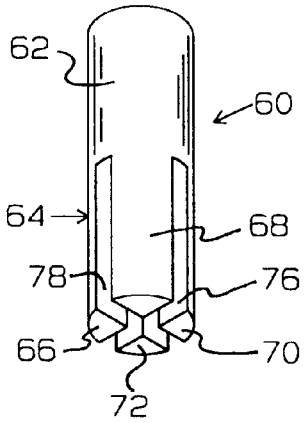
FIG. 2 is a perspective view of a reinforcement insert, per se, as used with the invention.

With reference to FIG. 1, a typical water tank or receptacle of simplified rectangular form as might be used on a firefighting vehicle, or the like, is generally illustrated at 10. The tank 10 includes longitudinal walls 12, end walls 14 and a bottom wall 16. The tank would also include an upper wall which is not shown for purpose of illustration. The tank may be formed of polymeric material such as polypropylene or polyethylene. Usually, water tanks located within fire truck vehicles will be specially configured to the available space, but for purpose of illustration, a simple rectangular tank is shown and the inventive concepts may be practiced with any configuration of water tank.

Figure 3:
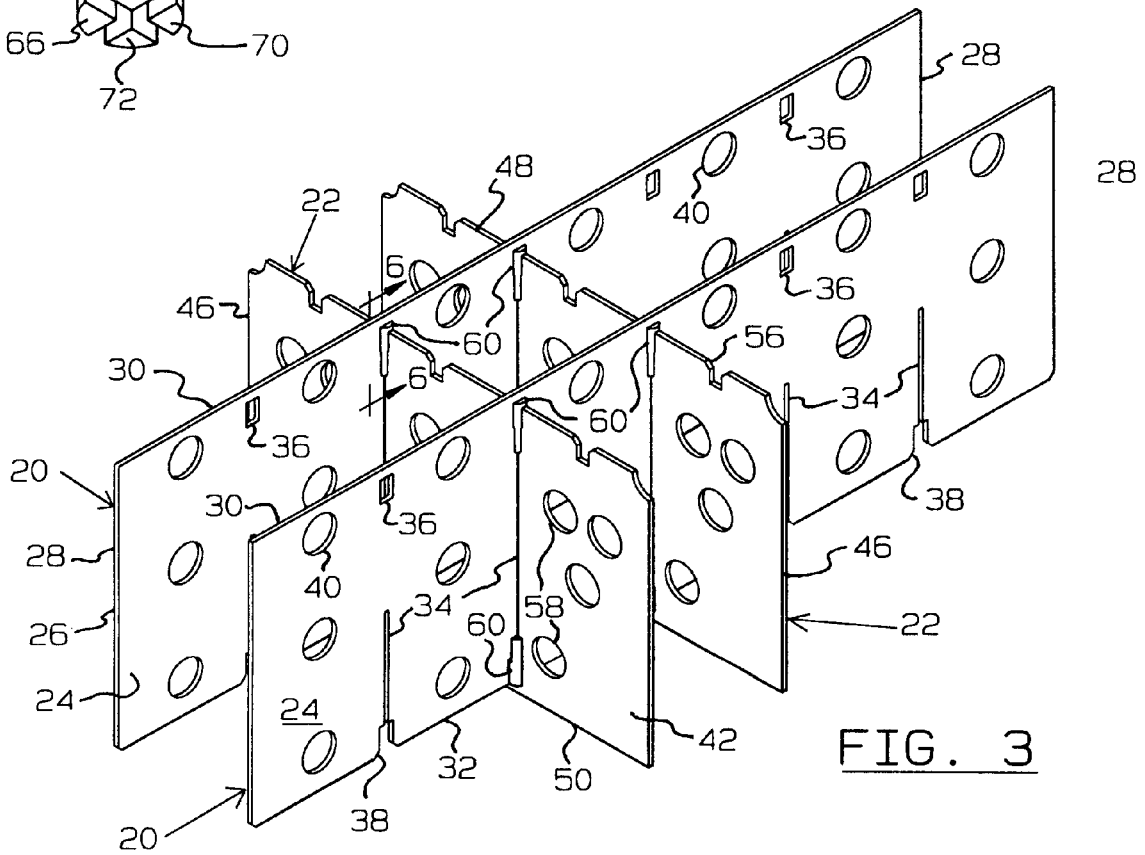
FIG. 3 is a perspective view of a partially assembled tank baffle in accord with the invention showing two transverse plate members in assembled relationship to two longitudinal plate members.

The baffle used within the tank 10 to control water surging is generally indicated at 18, FIG. 1. The baffle consists of a plurality of longitudinal plate members 20 and transverse plate members 22. The plate members 20 and 22 are preferably formed of a polymeric material such as polypropylene or polyethylene, and the plate members are preferably flat and longitudinal plate member 20 includes side 24 and the opposite side 26. The plate member ends 28 would engage the tank end walls 14, and the plate member 20 includes an upper edge 30 and a lower edge 32. A plurality of linear slots 34 are formed in plate member 20 intersecting sides 24 and 26, and as will be appreciated from FIGS. 3 and 4, the slots 34 are spaced along the length of the plate member 20, intersect the lower edge 32, and terminate in the plate member central region. Preferably, the length of the slots 34 is approximately one-half the distance between edges 30 and 32.

A plurality of rectangular insert receiving openings 36 are defined in the plate member 20 adjacent the upper edge 30 and in alignment with a slot 34, and notch 38 is defined in the plate member 20 adjacent the lower edge 32 and in alignment with each slot 34 for receiving a reinforcing insert, as later described. A plurality of surge holes 40 are defined in the plate member 20 intersecting sides 24 and 26 permitting restricted lateral movement of water through the holes, but the holes are not of sufficient dimension as to permit excessive water flow therethrough as to produce surging.

The transverse plate members 22 are similar to the longitudinal plate members 20 except that the dimension will be different with respect to length. The transverse plate members 22 include flat sides 42 and 44. The ends 46 will engage the tank walls 12, and the plate members 22 each include an upper edge 48 and a lower edge 50.

Figure 4:
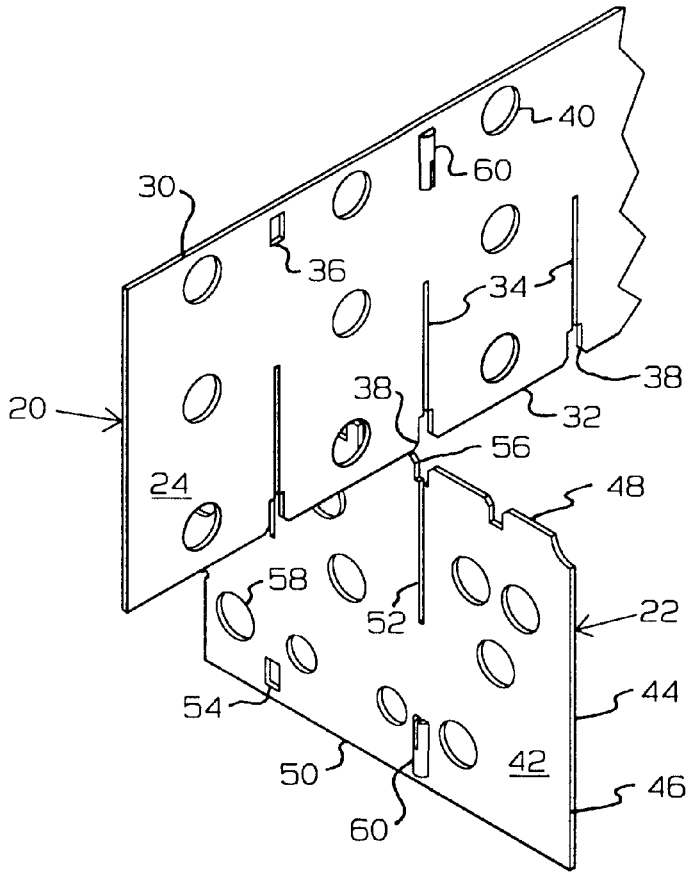
FIG. 4 is a perspective view of a longitudinal plate member and a transfer plate member in alignment and prior to transverse assembly.
Figure 5:
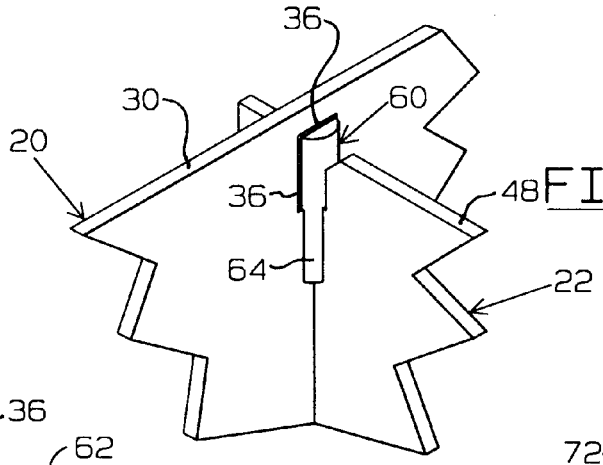
FIG. 5 is a perspective enlarged detail view of a reinforcing insert associated with plate members.

Transverse slots 52 are defined in plate members 22 intersecting the upper edge 48, and reinforcement insert receiving rectangular openings 54 are defined adjacent the lower edge 50 in alignment with the slots 52, FIG. 4. Notches 56 are formed in the plate member 22 in the upper edge 48 in alignment with the slots 52 wherein the notches 56 constitute tension of the slots 52 and receive the inserts of plate member 20. Surge holes 58 are defined in the plate member 22 intersecting the sides 42 and 44.

Preferably, the reinforcing inserts 60 which are located within the plate member openings 36 and 54 are identical and are formed from the same polymeric material plate members. The inserts 60, best shown in FIGS. 2 and 5–7, include a cylindrical base 62 which has a diameter only slightly less than the width of the insert openings 36 and 54. Each insert 60 includes four fingers generally indicated at 64 which extend from the base 62 in a cantilevered manner and the fingers 64 include fingers 66, 68, 70 and 72, the transverse cross section of each finger being of a quadrant type form, FIG. 7, wherein flat right angular shoulders 74 are defined upon each finger. The spacing between opposed finger shoulders is such as to define a pair of perpendiculary disposed slots 76 and 78.

Figure 6:
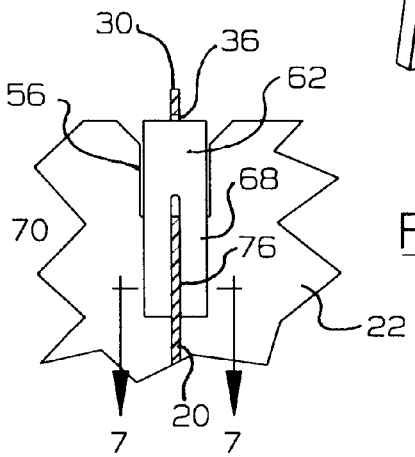
FIG. 6 is an elevational enlarged sectional detail view as taken along Section 6—6 of FIG. 3.
Figure 7:
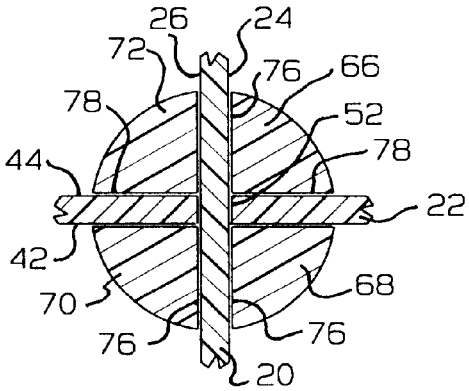
FIG. 7 is an enlarged plan sectional view as taken through a reinforcing insert and associated plate members along Section 7—7 of FIG. 6.

To assemble the baffle 18 first requires that the reinforcing inserts 60 be located within the openings 36 and 54 defined in the longitudinal plate member 20 and the transverse plate member 22, respectively. Insertion of the inserts into their openings consists of spreading the fingers 66–72 such that the fingers will be slightly deformed from their usual alignment with the length of the associated insert base 62 and can be inserted into their plane member opening far enough so that the insert base 62 is fully received within the opening so that the insert will assume the orientation shown in FIGS. 5–7. For instance, with reference to FIGS. 6 and 7, the finger 68 is temporarily deformed away from the finger 70 and the finger 66 is deformed away from the finger 72 which widens the slot 76. Thereupon, the lower end of the fingers 70 and 72 may be inserted through the insert opening 36 with the fingers extending toward the closest slot 34 and the insert pushed downwardly, FIG. 6, upon longitudinal plate member 20 until the insert base 62 is completely located within the insert opening 36, as shown in FIG. 6. Once the base 62 is fully located within opening 36, the entire insert will align with the plane of the plate member 20 and the width of slot 76 will return to normal, and at such time, the shoulders 74 on the fingers in opposed relationship to the plate member 20 will frictionally grip the plate member sides 24 and 26.

The inserts 60 are initially located within the insert receiving openings 36 and 54 of both plate members with the fingers extending toward the central region of the associated plate member and the slots 78 will align with the slots 34 and 52 formed in the associated plate member. To assemble the longitudinal plate members 20 and the transverse plate members 22, the plate members are aligned to each other as shown in FIG. 4. The length of the transverse plate member 22 is perpendicularly related to the length of the plate member 20 whereby the slots 34 and 52 will be aligned and the plate members can be translated toward each other in the direction of the slots 34 and 52. Initially, the slots 34 and 52 will intermesh or overlap each other, and because the slots 34 and 52 extend approximately one-half of the height of the plate members, and because the plate members are of substantially equal width, the plate member 22 will be received within the slot 78 of the aligned insert 60 on plate member 20, and simultaneously, the insert 60 mounted upon the lower plate member 22 and the insert 60 on the transverse plate member 22 will enter the insert slot 78. The notches 38 and 56 provide clearance for the insert base 62 as apparent in FIGS. 5 and 6. In this manner, the central regions of the plate members 20 and 22 will be in a mechanical locked relationship due to the receiving of the plate member 20 in the slot 52 of the transverse plate member 22, and the location of the transverse plate member 22 within the slot 34 of the plate member 20. Further, the edge regions of the transverse plate member 22 adjacent edges 48 and 50 will be reinforced against deformation by the upper and lower inserts 60.

If desired, the plate members 20 and 22 can be welded together by polymeric welding or solvents at limited areas or spots, and the close reception of the insert bases 62 within the openings 36 and 54 firmly supports and positions the other plate member by engagement with the fingers 64. It will be appreciated that the diameter of the inserts 60, and dimension of the fingers 64, is substantial enough to form sufficient strength to resist surging forces imposed upon the baffle components. If the vehicle containing the tank is involved in an accident, any welding of the baffle components that was previously done can be cut out, and the baffle quickly repaired.

It is appreciated that various modifications to the inventive concepts may be apparent to those skilled in the art without departing from the spirit and scope of the invention.

We claim:

1. A baffle for a receptacle containing liquid to control surging comprising, in combination, longitudinal and transverse plate members each formed of a polymeric material and each having first and second sides and each having upper and lower edges defining said plate members' height and end edges defining said plate members' length, a first linear slot defined within said longitudinal plate member substantially perpendicularly intersecting said lower edge thereof, a second linear seat defined within said transverse plate member substantially perpendicularly intersecting said upper edge thereof, a first reinforcement insert receiving opening defined in said longitudinal plate member adjacent said upper edge thereof and in alignment with the length of said first slot, a second reinforcement insert receiving opening defined in said transverse plate member adjacent said lower edge thereof and in alignment with the length of said second slot, a reinforcement insert located within each of said openings, said inserts each including a base positioned within the opening in which they are received and four cantilevered fingers extending from said base and said opening in the direction of the slot of the plate member in which said insert is received, said fingers of a common base being parallel and spaced with respect to each other, the spacing between adjacent fingers defining a third slot receiving the other plate member in which said opening is not defined and defining a fourth slot in alignment with said slot of the plate member in which said opening is defined, said slots defined in said plate members being of sufficient length that upon transversely relating said plate members to each other to align said first and second slots and translating said plate members toward each other parallel to said first and second slots said inserts' third slots to receive the other plate member in which said opening is not defined adjacent a plate member edge whereby said inserts' fingers support said plate members adjacent said edges against deformation.

2. In a baffle for a receptacle as in claim 1 wherein said transverse plate member upper edge is located adjacent said longitudinal plate member upper edge and said transverse plate member lower edge is located adjacent said longitudinal plate member lower edge.

3. In a baffle for a receptacle as in claim 1, said longitudinal and transverse plate members and said inserts being formed of a polymeric material.

4. In a baffle for a receptacle as in claim 3, the height of said longitudinal and transverse plate members being substantially equal.

5. In a baffle for a receptacle as in claim 3, said reinforcement insert receiving openings being rectangular in configuration having a uniform width in the direction of the length of the associated plate member, said inserts' base being cylindrical having a diameter slightly less than said opening's uniform width, and said fingers homogeneously extend from the associated base each having a transverse cross sectional quadrant configuration.

6. In a baffle for a receptacle as in claim 1 wherein the baffle comprises a plurality of longitudinal and transverse plate members, said longitudinal plate members being substantially identical and said transverse plate members being substantially identical.

7. In a baffle for a receptacle as in claim 1, an insert base clearance notch defined in said longitudinal plate member lower edge in alignment with said first slot and an insert base clearance notch defined in said transverse plate member upper edge in alignment with said second slot, said notches providing clearance for said reinforcement insert bases upon said plate members being assembled.

8. In a baffle for a receptacle as in claim 1, the height of said longitudinal and transverse plate members being substantially equal and the length of said first and second slots being substantially one-half of the height of the associated plate member.

9. A baffle for a receptacle containing liquid to control surging comprising, in combination, a plurality of spaced parallel longitudinal plate members, a plurality of spaced parallel transverse plate members intersecting said longitudinal plate members, each of said plate members having longitudinal edges and a central region therebetween, linear transverse slots defined in said longitudinal plate members intersecting an edge of said longitudinal plate members and terminating at said central region of said longitudinal plate members, said slots of said longitudinal plate members receiving a transverse plate member, and a reinforcement insert mounted upon each longitudinal plate member adjacent the edge thereof remote from the slot defined in said longitudinal plate members and in alignment with the slot defined in the common plate member receiving and supporting the intersecting transverse plate member edge.

10. In a baffle for a receptacle as in claim 9, said plate members and inserts being formed of a polymeric material.

* * * * *